United States Patent [19]

Taira et al.

[11] Patent Number: 4,464,209

[45] Date of Patent: Aug. 7, 1984

[54] CLAD STEEL PIPE EXCELLENT IN CORROSION RESISTANCE AND LOW-TEMPERATURE TOUGHNESS AND METHOD FOR MANUFACTURING SAME

[75] Inventors: Tadaaki Taira; Junichiro Takehara; Yasuo Kobayashi; Kazuyoshi Ume, all of Fukuyama, Japan

[73] Assignee: Nippon Kokan Kabushiki Kaisha, Tokyo, Japan

[21] Appl. No.: 465,349

[22] Filed: Feb. 9, 1983

[30] Foreign Application Priority Data

Feb. 27, 1982 [JP] Japan ..... 57-31313

[51] Int. Cl.[3] ..... B21C 37/06; B32B 1/08

[52] U.S. Cl. ..... 148/36; 148/12 E; 148/37; 148/38; 148/135; 148/136; 428/682; 428/683

[58] Field of Search ..... 148/36, 37, 38, 12 E, 148/135, 136; 428/683, 682

[56] References Cited

U.S. PATENT DOCUMENTS

| | | | |
|---|---|---|---|
| 2,034,278 | 3/1936 | Becket et al. | 428/683 |
| 3,885,922 | 5/1975 | Thomas, Jr. et al. | 428/683 |
| 3,976,520 | 8/1976 | Reinke et al. | 428/683 |
| 4,178,417 | 12/1979 | Oda et al. | 428/683 |

*Primary Examiner*—W. Stallard

*Attorney, Agent, or Firm*—Frishauf, Holtz, Goodman & Woodward

[57] ABSTRACT

A clad steel pipe excellent in corrosion resistance and low-temperature toughness, which comprises a cladding sheet of high corrosion resistant steel and a substrate sheet of low-alloy high-strength steel, the substrate sheet consisting, as the fundamental constituents, essentially of:

carbon: from 0.002 to 0.050 wt. %,
silicon: from 0.05 to 0.80 wt. %,
manganese: from 0.80 to 2.20 wt. %,
niobium: from 0.01 to 0.10 wt. %,
aluminum: from 0.01 to 0.08 wt. %,
nitrogen: from 0.002 to 0.008 wt. %, and,
the balance being iron and incidental impurities;

or, the substrate sheet further additionally containing, as the strength-improving constituents, at least one element selected from the group consisting of:

copper: from 0.05 to 1.00 wt. %,
nickel: from 0.05 to 3.00 wt. %,
chromium: from 0.05 to 1.00 wt. %,
molybdenum: from 0.03 to 0.80 wt. %,
vanadium: from 0.01 to 0.10 wt. %, and,
boron: from 0.0003 to 0.0030 wt. %;

or, the substrate sheet further additionally containing, as the toughness-improving constituent, titanium within the range of from 0.005 to 0.030 wt. %, the clad steel pipe being subjected to a solution treatment under the following conditions:

heating temperature: from 900° to 1,150° C.,
holding period: up to 15 minutes, and,
cooling rate: from 5° to 100° C./second.

16 Claims, 6 Drawing Figures

25μm

CLAD STEEL PIPE EXCELLENT IN CORROSION RESISTANCE AND LOW-TEMPERATURE TOUGHNESS AND METHOD FOR MANUFACTURING SAME

REFERENCE TO PATENTS, APPLICATIONS AND PUBLICATIONS PERTINENT TO THE INVENTION

As far as we know, there is no prior art document pertinent to the present invention.

FIELD OF THE INVENTION

The present invention relates to a clad steel pipe excellent in corrosion resistance and low-temperature toughness and a method for manufacturing same.

BACKGROUND OF THE INVENTION

Various research efforts have been made with a view to improving corrosion resistance and toughness of a transporting pipe for transporting a fluid containing a corrosive gas such as hydrogen sulfide gas or carbon dioxide gas, and since recently, a clad steel pipe comprising a cladding sheet of high corrosion resistant steel as the inner sheet and a substrate sheet of low-alloy high-strength steel as the outer sheet has been used as the transporting pipe at some localities for testing purposes.

The above-mentioned clad steel pipe is usually manufactured by overlaying a cladding sheet of high corrosion resistant steel with a substrate sheet of low-alloy high-strength steel and pressure-bonding them with each other through hot-rolling to prepare a clad steel sheet; forming said clad steel sheet thus prepared into a blank pipe having said cladding sheet inside and said substrate sheet outside; and welding a seam line of said blank pipe thus obtained.

However, as the service conditions of the clad steel pipe as the transporting pipe have become severer, corrosion resistance of the cladding sheet used in the conventional clad steel pipe has become insufficient. An insufficient corrosion resistance of the cladding sheet results from precipitation of carbides at grain boundaries of the clad steel during preparing the clad steel sheet through hot-rolling.

This problem can be solved by subjecting the clad steel pipe to a solution treatment, through which the clad steel pipe is heated to a prescribed temperature to dissolve the carbides precipitated at the grain boundaries into crystal grains of the cladding sheet, and then, is cooled at a cooling rate that prevents the dissolved carbides from reprecipitating at the grain boundaries.

While the solution treatment of the clad steel pipe improves corrosion resistance of the cladding sheet, the substrate sheet of the clad steel pipe is also affected by the heat treatment similarly to the cladding sheet. The structure of the substrate sheet is thus converted into a hardened structure, thus causing decrease in toughness of the substrate sheet. A clad steel pipe with a decreased toughness of the substrate sheet thereof is not serviceable.

If the clad steel pipe is subjected to a solution treatment and then to a tempering treatment to improve toughness of the substrate steel sheet in an attempt to solve the above-mentioned inconvenience, the cladding sheet is exposed to the same heat treatment as the substrate sheet, thus causing precipitation of carbides at grain boundaries, and hence decrease in corrosion resistance of the cladding sheet.

Because of these problems, it is the present situation that a solution treatment cannot be applied to a clad steel pipe for the purpose of improving corrosion resistance of a cladding sheet.

There is therefore an increasing demand for developing a clad steel pipe having a cladding sheet of high corrosion resistant steel and a substrate sheet of high low-temperature toughness steel. However, such a clad steel pipe has not as yet developed.

SUMMARY OF THE INVENTION

An object of the present invention is therefore to provide a clad steel pipe excellent in corrosion resistance and low-temperature toughness, which comprises a cladding sheet of high corrosion resistant steel and a substrate sheet of low-alloy high-strength steel and a method for manufacturing same.

In accordance with one of the features of the present invention, there is provided a clad steel pipe excellent in corrosion resistance and low-temperature toughness, which comprises a cladding sheet of high corrosion resistant steel and a substrate sheet of low-alloy high-strength steel, characterized by: said substrate sheet consisting essentially of:

carbon: from 0.002 to 0.050 wt. %,
silicon: from 0.05 to 0.80 wt. %,
manganese: from 0.80 to 2.20 wt. %,
niobium: from 0.01 to 0.10 wt. %,
aluminum: from 0.01 to 0.08 wt. %,
nitrogen: from 0.002 to 0.008 wt. %,
and,
the balance being iron and incidental impurities;

said cladding sheet being imparted a high corrosion resistance and said substrate sheet being imparted a high low-temperature toughness through a solution treatment applied under the following conditions:

heating temperature: from 900 to 1,150° C.,
holding period: up to 15 minutes, and
cooling rate: from 5 to 100° C./second;

and, there is also provided a method for manufacturing a clad steel pipe excellent in corrosion resistance and low-temperature toughness, which comprises: overlaying a cladding sheet of high corrosion resistant steel with a substrate sheet of low-alloy high-strength steel and pressure-bonding them with each other to prepare a clad steel sheet; forming said clad steel sheet thus prepared into a blank pipe; and, welding the seam line of said blank pipe thus obtained to manufacture a clad steel pipe which comprises said cladding sheet of high corrosion resistant steel and said substrate sheet of low-alloy high-strength steel; characterized by: using a steel sheet as said substrate sheet, which consists essentially of:

carbon: from 0.002 to 0.050 wt. %,
silicon: from 0.05 to 0.80 wt. %,
manganese: from 0.80 to 2.20 wt. %,
niobium: from 0.01 to 0.10 wt. %,
aluminum: from 0.01 to 0.08 wt. %, nitrogen: from 0.002 to 0.008 wt. %,
and,
the balance being iron and incidental impurities; and, subjecting said clad steel pipe to a solution treatment under the following conditions:

heating temperature: from 90 to 1,150° C.,
holding period: up to 15 minutes, and,
cooling rate: from 5 to 100° C./second;

thereby imparting a high corrosion resistance to said cladding sheet and imparting a high low-temperature toughness to said substrate sheet.

BRIEF DESCRIPTION OF THE DRAWINGS

FIG. 3 (B) is a microphotograph illustrating the structure of a steel with a lower carbon content;

DETAILED DESCRIPTION OF PREFERRED EMBODIMENTS

From the above-mentioned point of view, we kept our eyes on the fact that it is possible to improve corrosion resistance of the cladding sheet of a clad steel pipe, which has once decreased during preparing the clad steel sheet through hot-rolling, by using as the cladding sheet, a steel sheet having a high corrosion resistance such as austenitic stainless steel sheet, austenite-ferrite dual-phase stainless steel sheet, or high-nickel alloy steel sheet set forth in JIS G4902, manufacturing a clad steel pipe with such a steel sheet as the inner sheet, and subjecting said clad steel pipe to a solution treatment to dissolve carbides precipitated at grain boundaries into crystal grains of the cladding sheet.

However, application of the solution treatment to the clad steel pipe would subject the substrate sheet to a heat treatment similar to that of the cladding sheet and this reduces toughness of the substrate sheet.

To solve the above-mentioned problem, we carried out extensive studies, and as a result, we found that the decrease in toughness of the substrate sheet can be prevented by decreasing the carbon content in the substrate sheet, and, that the decrease in strength of the substrate sheet resulting from the decrease in the carbon content can be compensated by increasing the content of such elements as manganese contained in the substrate sheet.

First, we prepared various steel sheets with different carbon contents by changing the carbon content in steel sheets containing 0.25 wt. % silicon, 1.35 wt. % manganese, 0.02 wt. % niobium, and 0.04 wt. % vanadium. We heated these steel sheets to 1,050° C., then hardened them, and then investigated the effect of the carbon content on the tensile strength (TS) and the fracture transition temperature (vTrs) of as-hardened steel sheets.

Figure 1:
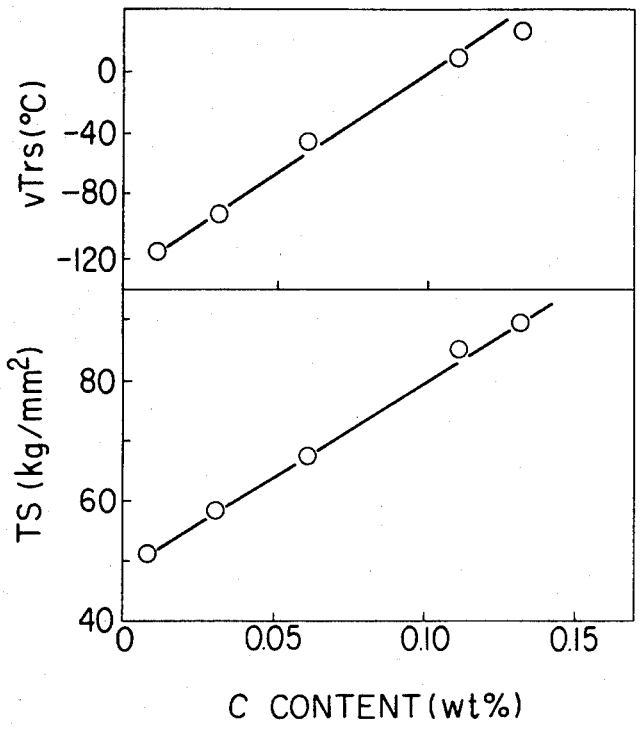
FIG. 1 is a graph illustrating the effect of the carbon content on the tensile strength and the fracture transition temperature.

These results are illustrated in FIG. 1. As is clear from FIG. 1, a lower carbon content leads to an improved toughness of the steel but to a decreased tensile strength of the steel sheet.

Figure 3A:
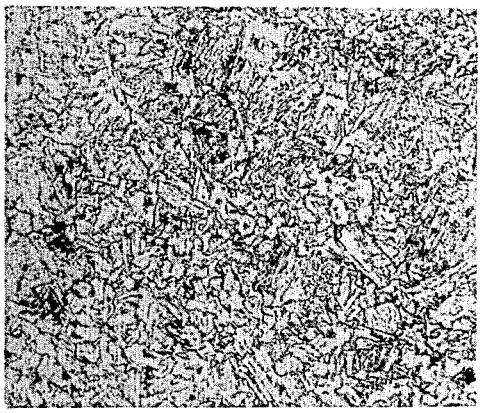
FIG. 3 (A) is a microphotograph illustrating the structure of a steel with a higher carbon content.
Figure 3B:
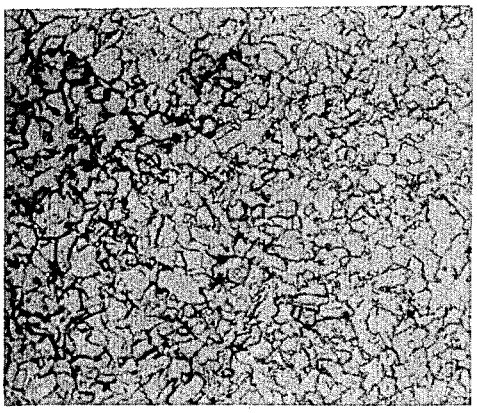

The reasons for this are as follows: From among the steel sheets used in the test mentioned above, FIG. 3 (A) gives the microphotograph of the as-hardened structure of the steel sheet having a carbon content of 0.13 wt. %, and FIG. 3 (B) gives the microphotograph of the as-hardened structure of the steel sheet having a carbon content of 0.03 wt. %. As is evident from FIG. 3 (A), the structure of a steel sheet having a high carbon content substantially comprises martensite. Toughness of a steel sheet with a high carbon centent is therefore decreased. As is clear from FIG. 3 (B), in contrast, a steel sheet having a low carbon content has a mixed structure of fine bainite and fine ferrite. In a steel sheet with a low carbon content, therefore, the tensile strength is low with however an improved toughness.

Then, we carried out the following test with a view to finding a method for compensating the decrease in the tensile strength of the steel sheet resulting from the decrease in the carbon content. More specifically, for steel sheets with a thickness of 20 mm subjected to a hardening treatment applied from a temperature within the range of from 900 to 1,100° C., we investigated the effect of the carbon equivalent (Ceq) calculated by the following equation on the tensile strength (TS) and the fracture transition temperature (vTrs) of the as-hardened steel sheets:

$$Ceq = C + (Mn/6) + [(Cu+Ni)/15] + [(Cr+Mo+V)/5]$$

Figure 2:
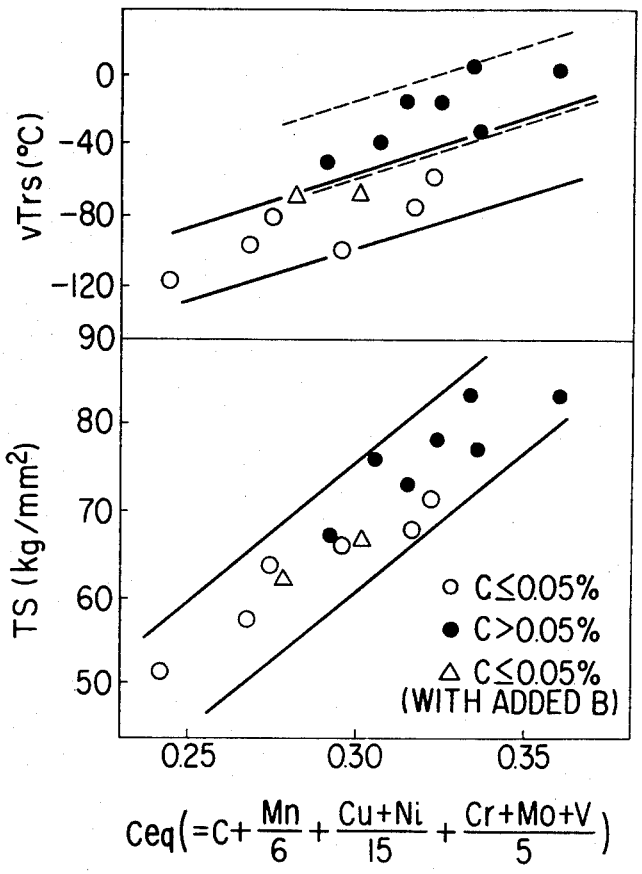
FIG. 2 is a graph illustrating the effect of the carbon equivalent on the tensile strength and the fracture transition temperature.

In FIG. 2, plots "o" represent data for the steel sheets having a carbon content of up to 0.05 wt. %; plots "•" represent data for the steel sheets having a carbon content of over 0.05 wt. %; and plots "Δ" represent data for the steel sheets having a carbon content of up to 0.05 wt. % and a boron content of up to 0.003 wt. %.

As is clear from FIG. 2, the tensile strength and the fracture transition temperature of an as-hardened steel sheet keep substantially a constant relationship with the carbon equivalent.

We also confirmed the existence of a constant relationship as mentioned above also for titanium which does not participate in the carbon equivalent.

This means that the decrease in the tensile strength of the steel sheet resulting from the decrease in the carbon content can be compensated by increasing the content of such elements as manganese, chromium, molybdenum and vanadium in the steel sheet.

For example, a tensile strength of at least 58 kg/mm$^2$ as specified by API Standard X70 may be obtained by increasing the carbon equivalent to at least 0.265, and a fracture transition temperature (vTrs) of up to −60° C. may be obtained by decreasing the carbon equivalent to up to 0.36, preferably, up to 0.33.

The present invention was made on the basis of the above-mentioned findings, and the clad steel pipe of the present invention excellent in corrosion resistance and low-temperature toughness, which comprises a cladding sheet of high corrosion resistant steel and a substrate sheet of low-alloy high-strength steel, and the method for manufacturing same are characterized by:

Said substrate sheet consisting, as the fundamental constituents, essentially of:

carbon: from 0.002 to 0.050 wt. %,
silicon: from 0.05 to 0.80 wt. %,
manganese: from 0.80 to 2.20 wt. %,
niobium: from 0.01 to 0.10 wt. %,
aluminum: from 0.01 to 0.08 wt. %,
nitrogen: from 0.002 to 0.008 wt. %,
and,
the balance being iron and incidental impurities;

or, said substrate sheet further additionally containing, as the strength-improving constituent, at least one element selected from the group consisting of:

copper: from 0.05 to 1.00 wt. %, nickel: from 0.05 to 3.00 wt. %,
chromium: from 0.05 to 1.00 wt. %,
molybdenum: from 0.03 to 0.80 wt. %,
vanadium: from 0.01 to 0.10 wt. %,
and,
boron: from 0.0003 to 0.0030 wt. %, or, said substrate sheet further additionally containing, as the toughness-improving constituent, titanium within the range of from 0.005 to 0.030 wt. %; said clad steel pipe being subjected to a solution treatment under the following conditions:

heating temperature: form 900 to 1,150° C.,
holding period: up to 15 minutes, and,
cooling rate: from 5 to 100° C./second;

thereby imparting a high corrosion resistance to said cladding sheet and imparting a high low-temperature toughness to said substrate sheet; said clad steel pipe of the present invention including a clad steel which comprises said cladding sheet as the inner sheet and said substrate sheet as the outer sheet and a clad steel pipe which comprises said substrate sheet as the inner sheet and said cladding sheet as the outer sheet.

Now, the reasons why the chemical composition of the fundamental constituents of the substrate sheet of the clad steel pipe of the present invention is limited as mentioned above are described below.

(1) Carbon:

Carbon has the effect, when decreasing the content thereof, of decreasing the strength of the substrate sheet but improving toughness of the substrate sheet. However, a carbon content of under 0.002 wt. % cannot give the minimum strength necessary for the substrate sheet. The carbon content should therefore be at least 0.002 wt. %. With a carbon content of over 0.050 wt. %, on the other hand, the as-hardened toughness of the substrate sheet cannot be improved up to −60° C. which is the conventional level as expressed by the fracture transition temperature (vTrs). The carbon content should therefore be up to 0.050 wt. %.

(2) Silicon:

While silicon has the deoxidizing effect, a silicon content of under 0.05 wt. % cannot give a desired deoxidizing effect. The silicon content should therefore be at least 0.05 wt. %. A silicon content of over 0.80 wt. %, on the other hand, causes decrease in toughness of the substrate sheet. The silicon content should therefore be up to 0.80 wt. %.

(3) Manganese:

Manganese has the effect of compensating the decrease in the strength of the substrate sheet resulting from the decrease in the carbon content. However, a manganese content of under 0.80 wt. % cannot give a desired effect as mentioned above. The manganese content should therefore be at least 0.80 wt. %. With a manganese content of over 2.20 wt. %, on the hand, the ashardened toughness of the substrate sheet cannot be improved up to −60° C. which is the conventional level as expressed by the fracture transition temperature (vTrs). The mangenese content should therefore be up to 2.20 wt. %.

(4) Niobium:

Niobium has the effect, when the substrate sheet is heated to the solution treatment temperature, of preventing austenite grains of the substrate sheet from becoming coarser through fine and uniform dispersion throughout the substrate sheet in the form of niobium carbonitride (Nb(CN)). A niobium content of under 0.01 wt. % cannot however give a desired effect as mentioned above. The niobium content should therefore be at least 0.01 wt. %. A niobium content of over 0.10 wt. % leads, on the other hand, to occurrence of surface flaws on the substrate sheet. The niobium content should therefore be up to 0.10 wt. %.

(5) Aluminum:

Aluminum is an element effective as a deoxidizer. When the substrate sheet is heated to the solution treatment temperature, aluminum is nitrided into aluminum nitride which has the effect of preventing austenite grains of the substrate sheet from becoming coarser. However, an aluminum content of under 0.01 wt. % cannot give a desired effect as mentioned above. The aluminum content should therefore be at least 0.01 wt. %. An aluminum content of over 0.08 wt. % results, on the other hand, in occurrence of surface flaws on the substrate sheet. The aluminum content should therefore be up to 0.08 wt. %.

(6) Nitrogen:

Nitrogen is an indispensable element for nitriding aluminum in aluminum nitrode which has the effect of preventing austenite grains of the substrate sheet from becoming coarser. However, a nitrogen content of under 0.002 wt. % cannot form aluminum nitride in an amount sufficient to prevent austenite grains from becoming coarser. The nitrogen content should therefore be at least 0.002 wt. %. A nitrogen content of over 0.008 wt. % reduces, on the other hand, toughness of the substrate sheet. The nitrogen content should therefore be up to 0.008 wt. %.

Now, the following paragraphs describe the reasons why the chemical composition of the strength-improving constituents, at least one of which is additionally contained in the substrate sheet for the similar purpose to that of manganese of compensating the decrease in the strength of the substrate sheet are limited as mentioned above.

(1) Copper:

Copper has the effect of improving strength and hydrogen-induced cracking resistance of the substrate sheet. A copper content of under 0.05 wt. % cannot however give a desired effect as mentioned above. The copper content should therefore be at least 0.05 wt. %. A copper content of over 1.00 wt. %, on the other hand, decreases hot-workability of the substrate sheet. The copper content should therefore be up to 1.00 wt. %.

(2) Nickel:

Nickel has the effect of improving strength and toughness of the substrate sheet and also of preventing occurrence of copper flaws. However, a nickel content of under 0.05 wt. % cannot give a desired effect as mentioned above. The nickel content should therefore be at least 0.05 wt. %. With a nickel content of over 3.00 wt. %, on the other hand, cracks may occur in the substrate sheet when welding a seam line of the blank pipe, and in addition to this, nickel is rather expensive. The nickel content should therefore be up to 3.00 wt. %.

(3) Chromium:

Chromium has the effect of improving strength of the substrate sheet. However, a chromium content of under 0.05 wt. % cannot give a desired effect as mentioned above. The chromium content should therefore be at least 0.05 wt. %. A chromium content of over 1.00 wt. %, on the other hand, leads to decrease in toughness and weldability of the substrate sheet. The chromium content should therefore be up to 1.00 wt. %.

(4) Molybdenum:

For the same reasons as for chromium, the molybdenum content should be within the range of from 0.03 to 0.80 wt. %.

(5) Vanadium:

For the same reasons as for chromium, the vanadium content should be within the range of from 0.01 to 0.10 wt. %.

(6) Boron:

Boron has the effect of compensating the decrease in strength of the substrate sheet in the extra-low carbon content region. However, a boron content of under 0.0003 wt. % cannot give a desired effect as mentioned above. The boron content should therefore be at least 0.0003 wt. %. A boron content of over 0.0030 wt. %, on the other hand, results in a decreased toughness of the substrate sheet. The boron content should therefore be up to 0.0030 wt. %.

Now, the following paragraph describes the reasons why the content of titanium which is additionally contained in the substrate sheet as the toughness-improving constituent is limited as mentioned above.

Titanium has the effect of preventing austenite grains from becoming coarser through precipitation of titanium nitride dispersed uniformly and finely into the structure of the substrate sheet at austenite grain boundaries of the substrate sheet, thus improving toughness of the substrate sheet. Titanimum has another effect, when adding boron, of causing preferential combination with boron over nitrogen to protect boron from nitrogen. However, a titanium content of under 0.005 wt. % cannot give a desired effect as mentioned above. The titanium content should therefore be at least 0.005 wt. %. With a titanium content of over 0.030 wt. %, on the other hand, no particular improvement is observed in the above-mentioned effect. The titanium content should therefore be up to 0.030 wt. %.

Now, the reasons of limiting the solution treatment conditions as mentioned above are described below.

(1) Heating temperature:

Heating the clad steel pipe to a temperature within the range of from 900° C. to 1,150° C. causes dissolution of carbides into austenite grains of the cladding sheet, thus improving corrosion resistance of the cladding sheet. A heating temperature of under 900° C. cannot however sufficiently dissolve carbides into austenite grains of the cladding sheet and cannot therefore improve corrosion resistance of the cladding sheet. It is therefore necessary to heat the clad steel pipe to a temperature of at least 900° C. When the clad steel pipe is heated to a temperature of over 1,150° C., on the other hand, austenite grains of the substrate sheet become coarser, thus reducing toughness of the substrate sheet. It is therefore necessary to heat the clad steel pipe to a temperature of up to 1,150° C.

(2) Holding period:

In order to sufficiently dissolve carbides into austenite grains of the cladding sheet, it is desirable to heat the clad steel pipe for a long period of time. However, when the clad steel pipe is heated for a period of over 15 minutes, austenite grains of the substrate sheet become coarser, thus decreasing toughness of the substrate sheet. The clad steel pipe should therefore be heated for a period of time of up to 15 minutes.

(3) Cooling rate:

After heating the clad steel pipe to a prescribed temperature for a prescribed period of time as mentioned above, it is necessary to rapidly cool the clad steel pipe in order to prevent carbides dissolved in the austenite grains of the cladding sheet from reprecipitating at the grain boundaries. When cooling the clad steel pipe at a cooling rate of under 5° C./second, however, carbides precipitate at austenite grain boundaries of the cladding sheet, thus reducing toughness of the cladding sheet. It is therefore necessary to cool the clad steel pipe at a cooling rate of at least 5° C./second. On the other hand, it is very diffiuclt at the present level of technology to cool the clad steel pipe at a cooling rate of over 100° C./second. The cooling rate is therefore specified to be up to 100° C./second.

For the purpose of further improving hydrogen-induced cracking resistance of the substrate sheet, calcium may be added in an amount within the range of from 0.0001 to 0.0100 wt. % to the substrate sheet.

Now, the clad steel pipe and the method for manufacturing same of the present invention are described in detail by means of an example while comparing with clad steel pipes outside the scope of the present invention.

EXAMPLE

Clad steel sheets were prepared by overlaying the respective cladding sheets having the chemical compositions (5 pairs) as shown in Table 1 with the respective substrate sheets having the chemical compositions as shown also in Table 1, and pressure-bonding the paired cladding sheets and the substrate sheets by hot-rolling. The clad steel sheets thus prepared were formed by the UOE method into blank pipes each having the cladding sheet inside and the substrate sheet outside. Seam lines of the blank pipes thus obtained were welded to manufacture clad steel pipes. Then, these clad steel pipes were put into an induction heating furnace, heated to a temperature of 1,100° C. for seven minutes, and then immediately cooled at a cooling rate of from 50° C./second to 60° C./second. Tensile test pieces 3 and Charpy test pieces 4 were cut, as shown is FIGS. 4 and 5, from the substrate sheets 1 of the clad steel pipes Nos. 1 to 3 thus obtained within the scope of the present invention as shown in Table 1 and from the substrate sheet 1 of the clad steel pipes Nos. 4 to 5 thus obtained outside the scope of the present invention as shown in Table 1. The test pieces Nos. 1 to 3 of the clad steel pipes within the scope of the present invention and the test pieces Nos. 4 to 5 of the clad steel pipes outside the scope of the present invention, thus obtained, were subjected respectively to a tensile test and a Charpy test.

Figure 4:
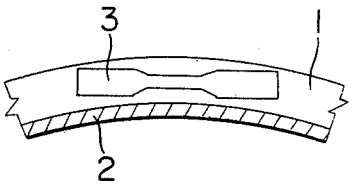
FIG. 4 is a drawing illustrating a manner of cutting a test piece to be subjected to a tensile test; and, FIG. 5 is a drawing illustrating a manner of cutting a test piece to be subjected to a Charpy test.
Figure 5:
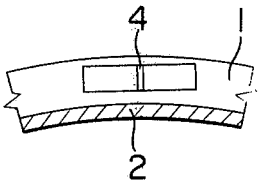

The above-mentioned tensile test pieces 3 had dimensions of 6 mm diameter×25 mm gauge length as shown in FIG. 4, and the Charpy test pieces 4 had dimensions of 10 mm×10 mm×55 mm as shown in FIG. 5.

The results of the above-mentioned tensile test and Charpy test are shown in Table 2.

TABLE 1

| Tested clad steel pipe No. | | | Standard | Thickness (mm) | C | Si | Mn | Cu | Ni | Cr | Mo | Nb | V | Ti | B | Al | Ceq |
|---|---|---|---|---|---|---|---|---|---|---|---|---|---|---|---|---|---|
| Clad steel | 1 | Substrate | API | 18 | 0.03 | 0.32 | 1.42 | — | — | — | — | 0.045 | — | — | — | 0.035 | 0.27 |

TABLE 1-continued

| Tested clad steel pipe No. | | | Standard | Thickness (mm) | C | Si | Mn | Cu | Ni | Cr | Mo | Nb | V | Ti | B | Al | Ceq |
|---|---|---|---|---|---|---|---|---|---|---|---|---|---|---|---|---|---|
| pipe of the present invention | | sheet | × 52 | | | | | | | | | | | | | | |
| | | Cladding sheet | JIS SUS304 | 2 | 0.05 | 0.67 | 1.65 | | 10.37 | 18.52 | 0.14 | — | — | — | — | 0.006 | — |
| | 2 | Substrate sheet | API × 60 | 23 | 0.01 | 0.29 | 1.25 | — | — | — | 0.20 | 0.052 | 0.041 | 0.017 | 0.0011 | 0.041 | 0.27 |
| | | Cladding sheet | JIS SUS304 | 2 | 0.05 | 0.67 | 1.65 | — | 10.37 | 18.52 | 0.14 | — | — | — | — | 0.006 | — |
| | 3 | Substrate sheet | API × 70 | 16 | 0.02 | 0.28 | 1.72 | — | — | — | — | 0.049 | — | — | — | 0.033 | 0.31 |
| | | Cladding sheet | JIS SUS316 | 3 | 0.06 | 0.78 | 0.97 | — | 10.24 | 17.18 | 2.23 | — | — | — | — | — | — |
| Reference clad steel pipe | 4 | Substrate sheet | API × 52 | 18 | 0.10 | 0.27 | 0.95 | — | — | — | — | 0.025 | — | 0.015 | — | 0.023 | 0.26 |
| | | Cladding sheet | JIS SUS304 | 2 | 0.05 | 0.67 | 1.65 | — | 10.37 | 18.52 | 0.14 | — | — | — | — | 0.006 | — |
| | 5 | Substrate sheet | API × 70 | 16 | 0.13 | 0.26 | 1.19 | 0.30 | 0.14 | — | — | — | 0.051 | — | — | 0.020 | 0.37 |
| | | Cladding sheet | JIS SUS316 | 3 | 0.06 | 0.78 | 0.97 | — | 10.24 | 17.18 | 2.23 | — | — | — | — | — | — |

TABLE 2

| Test piece No. | | API Standard YS (Kg/mm²) | API Standard TS (Kg/mm²) | Tensile test YS (Kg/mm²) | Tensile test TS (Kg/mm²) | Charpy test vTrs (°C.) | Charpy test E-20° C. (Kg · m) |
|---|---|---|---|---|---|---|---|
| Test piece cut from clad steel pipe of the present invention | 1 | × 52 36.6 | 46.4 | 40.2 | 52.2 | −73 | 38.5 |
| | 2 | × 60 42.2 | 52.8 | 49.0 | 59.8 | −65 | 41.2 |
| | 3 | × 70 49.2 | 57.6 | 57.2 | 64.3 | −74 | 37.5 |
| Test piece cut from reference clad steel pipe | 4 | × 52 36.6 | 46.4 | 66.2 | 71.2 | −5 | 0.8 |
| | 5 | × 70 49.2 | 57.6 | 87.9 | 92.5 | +13 | 0.4 |

As is clear from Table 2, low-temperature toughness is considerably improved in all the test pieces Nos. 1 to 3 of the clad steel pipes of the present invention as compared with the test pieces Nos. 4 and 5 of the reference clad steel pipes outside the scope of the present invention. In all the test pieces Nos. 1 to 3 of the clad steel pipes of the present invention, furthermore, the tensile strength is superior to that specified in the API Standard.

Then, test pieces of dimensions of 2 mm×25 mm×50 mm were cut from the cladding sheet 2 of the clad steel pipe No. 1 within the scope of the present invention and from the cladding sheet 2 of the clad steel pipe No. 4 outside the scope of the present invention, and these test pieces were subjected to a corrosion test.

The above-mentioned corrosion test was carried out by dipping each of the above-mentioned test pieces into boiling 65% nitric acid solution, and investigating the corrosion rate for each test piece.

As a result of the above-mentioned corrosion test, the test piece of the clad steel pipe No. 1 of the present invention showed a corrosion rate of 0.28 g/m²/hr, whereas the test piece of the clad steel pipe No. 4 outside the scope of the present invention showed a corrosion rate of 0.37 g/m²/hr. It is therefore evident that the clad steel pipe of the present invention is less susceptible of corrosion as compared with the clad steel pipe outside the scope of the present invention.

Then, test pieces of dimensions of 3 mm×25 mm×50 mm were cut from the cladding sheet 2 of the clad steel pipe No. 3 within the scope of the present invention and from the cladding sheet 2 of the clad steel pipe No. 5 outside the scope of the present invention, and these test pieces were subjected to another corrosion test.

The above-mentioned corrosion test was carried out by dipping each of the above-mentioned test pieces into boiling 5% sulfuric acid solution, and investigating the corrosion rate for each test piece.

As a result of the above-mentioned corrosion test, the test piece of the clad steel pipe No. 3 of the present invention showed a corrosion rate of 4.48 g/m²/hr, whereas the test piece of the clad steel pipe No. 5 outside the scope of the present invention showed a corrosion rate of 5.61 g/m²/hr. It is therefore evident that the clad steel pipe of the present invention is less susceptible of corrosion as compared with the clad steel pipe outside the scope of the present invention.

In addition, for the purpose of investigating corrosion resistance of the welded bead zone and the welding heat affected zone of the cladding sheets of the clad steel pipe within the scope of present invention, test pieces including the welded bead zone and the welding heat affected zone were cut from the cladding sheets of the clad steel pipes Nos. 1 to 3 of the present invention and subjected to the above-mentioned corrosion tests. The results permitted confirmation that corrosion resistance of the welded bead zone and the welding heat affected zone is almost identical with that of the other portions.

The clad steel pipe comprising a cladding sheet of high corrosion resistant steel as the inner sheet and a substrate sheet of low-alloy high-strength steel as the outer sheet and the method for manufacturing same have been described above in detail. When using a clad steel pipe in a fluid containing a corrosive gas such as hydrogen sulfide gas or carbon dioxide gas, it suffices just to reverse the cladding sheet and the substrate sheet. More particularly, the clad steel pipe would comprise in this case the substrate sheet of low-alloy high-strength steel as the inner sheet and the cladding sheet of high corrosion resistant steel as the outer sheet.

According to the present invention, as described above in detail, it is possible to obtain a clad steel pipe excellent in corrosion resistance and low-temperature toughness, which comprises a cladding sheet of high corrosion resistant steel and a substrate sheet of low-alloy high-strength steel, thus providing industrially useful effects.

What is claimed is:

1. A clad steel pipe excellent in corrosion resistance and low-temperature toughness, which comprises a cladding sheet of high corrosion resistant steel and a substrate sheet of low-alloy high-strength steel, characterized by:

said substrate sheet consisting essentially of:
carbon: from 0.002 to 0.050 wt. %,
silicon: from 0.05 to 0.80 wt. %,
manganese: from 0.80 to 2.20 wt. %,
niobium: from 0.01 to 0.10 wt. %,
aluminum: from 0.01 to 0.08 wt. %,
nitrogen: from 0.002 to 0.008 wt. %,
and,
the balance being iron and incidental impurities; and, said cladding sheet being imparted high corrosion resistance and said substrate sheet being imparted high low-temperature toughness through a solution treatment applied under the following conditions:
heating temperature: from 900° to 1,150° C.
holding period: up to 15 minutes, and,
cooling rate: from 5° to 100° C./second.

2. The clad steel pipe as claimed in claim 1, characterized by:

said substrate sheet further additionally containing at least one element selected from the group consisting of:
cooper: from 0.05 to 1.00 wt. %,
nickel: from 0.05 to 3.00 wt. %,
chromium: from 0.05 to 1.00 wt. %,
molybdenum: from 0.03 to 0.80 wt. %,
vanadium: from 0.01 to 0.10 wt. %,
and,
boron: from 0.0003 to 0.0030 wt. %.

3. The clad steel pipe as claimed in claim 1, characterized by:

said substrate sheet further additionally containing titanium within the range of from 0.005 to 0.030 wt. %.

4. The clad steel pipe as claimed in claim 2, characterized by:

said substrate sheet further additionally containing titanium within the range of from 0.005 to 0.030 wt. %.

5. The clad steep pipe as claimed in claim 1 or 2, characterized by:

said clad steel pipe comprising said cladding sheet as the inner sheet and said substrate sheet as the outer sheet.

6. The clad steel pipe as claimed in claim 3 or 4, characterized by:

said clad steel pipe comprising said cladding sheet as the inner sheet and said substrate sheet as the outer sheet.

7. The clad steel pipe as claimed in claim 1 or 2, characterized by:

said clad steel pipe comprising said substrate sheet as the inner sheet and said cladding sheet as the outer sheet.

8. The clad steel pipe as claimed in claim 3 or 4, characterized by:

said clad steel pipe comprising said substrate sheet as the inner sheet and said cladding sheet as the outer sheet.

9. A method for manufacturing a clad steel pipe excellent in corrosion resistance and low-temperature toughness, which comprises:

overlaying a cladding sheet of high corrosion resistant steel with a substrate sheet of low-alloy high-strength steel and pressure-bonding them to each other to prepare a clad steel sheet; forming said clad steel sheet thus prepared into a blank pipe; and, welding the seam line of said blank pipe thus obtained to manufacture a clad steel pipe which comprises said cladding sheet of high corrosion resistant steel and said substrate sheet of low-alloy high-stength steel;

characterized by:

using a steel sheet, as said substrate sheet, which consists essentially of:
carbon: from 0.002 to 0.050 wt. %,
silicon: from 0.05 to 0.80 wt. %,
manganese: from 0.80 to 2.20 wt. %,
niobium: from 0.01 to 0.10 wt. %,
aluminum: from 0.01 to 0.08 wt. %,
nitrogen: from 0.002 to 0.008 wt. %,
and,
the balance being iron and incidental impurities; and, subjecting said clad steel pipe to a solution treatment under the following conditions:
heating temperature: from 900° to 1,150° C.,
holding period: up to 15 minutes, and,
cooling rate: from 5 to 100° C./second;

thereby imparting a high corrosion resistance to said cladding sheet and imparting a high low-temperature toughness to said substrate sheet.

10. The method as claim in claim 9, characterized by:

using said steel sheet, as said substrate sheet, which further additionally contains at least one element selected from the group consisting of:
copper: from 0.05 to 1.00 wt. %,
nickel: from 0.05 to 3.00 wt. %,
chromium: from 0.05 to 1.00 wt. %,
molybdenum: from 0.03 to 0.80 wt. %,
vanadium: from 0.01 to 0.10 wt. %,
and,
boron: from 0.0003 to 0.0030 wt. %.

11. The method as claimed in claim 9, characterized by:

using said steel sheet, as said substrate sheet, which further additionally contains titanium within the range of from 0.005 to 0.030 wt. %.

12. The method as claimed in claim 10, characterized by:

using said steel sheet, as said substrate sheet, which further additionally contains titanium within the range of from 0.005 to 0.030 wt. %.

13. The method as claimed in claim 9 or 10, characterized by:

forming said clad steel sheet into a blank pipe having said cladding sheet inside and said substrate sheet outside.

14. The method as claimed in claim 11 or 12, characterized by:

forming said clad steel sheet into a blank pipe having said cladding sheet inside and said substrate sheet outside.

15. The method as claimed in claim 9 or 10, characterized by:

forming said clad steel sheet into a blank pipe having said substrate sheet inside and said cladding sheet outside.

16. The method as claimed in claim 11 or 12, characterized by:

forming said clad steel sheet into a blank pipe having said substrate sheet inside and said cladding sheet outside.

* * * * *

UNITED STATES PATENT AND TRADEMARK OFFICE

CERTIFICATE OF CORRECTION

PATENT NO. : 4,464,209

DATED : August 7, 1984

INVENTOR(S) : Tadaaki TAIRA et al

It is certified that error appears in the above-identified patent and that said Letters Patent is hereby corrected as shown below:

Column 1, lines 6-12: delete in entirety.
line 33: replace "with" with --to--.

Column 6, line 21: replace "in" with --to--.
line 21: replace "nitrode" with --nitride--.

Column 11, line 8: after "pipe" insert --having--.
line 9: after "excellent" delete "in".
line 42: replace "cooper" with --copper--.

Column 12, line 24: replace "stength" with --strength--.

Signed and Sealed this

*Fourth* Day of *March 1986*

[SEAL]

*Attest:*

DONALD J. QUIGG

*Attesting Officer*

*Commissioner of Patents and Trademarks*